US005392016A

United States Patent [19]

Arnold et al.

[11] Patent Number: 5,392,016

[45] Date of Patent: Feb. 21, 1995

[54] MOLDED CASE CIRCUIT BREAKER MECHANICAL RATING PLUG

[75] Inventors: David Arnold, Chester; Roger N. Castonguay, Terryville, both of Conn.

[73] Assignee: General Electric Company, New York, N.Y.

[21] Appl. No.: 148,240

[22] Filed: Nov. 8, 1993

[51] Int. Cl.[6] ..... H01H 9/00

[52] U.S. Cl. ..... 335/176; 335/45

[58] Field of Search ..... 335/35, 36, 38, 40, 335/41, 42, 45, 167–176

[56] References Cited

U.S. PATENT DOCUMENTS

| | | | |
|---|---|---|---|
| 4,130,814 | 12/1978 | Bruchet | 335/42 |
| 4,649,455 | 3/1987 | Scott . | |
| 4,679,016 | 7/1987 | Ciarcia et al. . | |
| 4,736,174 | 4/1988 | Castonguay et al. . | |
| 4,763,096 | 8/1988 | Ingrain | 335/42 |

*Primary Examiner*—Lincoln Donovan

*Attorney, Agent, or Firm*—Richard A. Menelly

[57] ABSTRACT

A molded case circuit breaker having a thermal-magnetic trip unit is provided with a mechanical rating plug to allow a number of circuit breakers of different ampere ratings to be used within a common-sized enclosure. Multiple mechanical rating plugs are stored at the place of distribution to adapt the common enclosure to a specific ampere rating at a substantial savings in time, labor and materials.

14 Claims, 3 Drawing Sheets

MOLDED CASE CIRCUIT BREAKER MECHANICAL RATING PLUG

BACKGROUND OF THE INVENTION

The advent of electronic trip units allows the use of an electronic rating plug to set the circuit breaker ampere rating within a common-sized industrial-rated circuit breaker enclosure. Wherein earlier circuit breakers employing thermal-magnetic trip units were designed to meet the various circuit breaker ampere ratings by conforming the size of the circuit breaker components and the circuit breaker enclosure, a large variety of such circuit breakers were stored at the distribution site to meet the electrical distribution market requirements. U.S. Pat. No. 4,649,455 entitled "Rating Plug for Molded Case Circuit Breaker" describes one example of the use of an electronic rating plug to set the circuit breaker ampere rating.

U.S. Pat. No. 4,679,016 describes an industrial-rated circuit breaker design that is economically assembled in an automated process. The circuit breaker utilizes a thermal-magnetic trip unit to interrupt circuit current under overcurrent conditions within a protected circuit. To accommodate the various circuit breaker ampere rating requirements, the circuit breaker entails several sizes. It would be economically advantageous to use a common-sized enclosure with such a circuit breaker employing a thermal-magnetic trip unit in view of the lower cost with the thermal-magnetic trip unit per se.

Accordingly, one purpose of the invention is to provide a so-called "mechanical rating plug" to allow circuit breakers using thermal-magnetic trip units to be arranged within a common-sized enclosure in a manner similar to the circuit breakers using an electronic trip unit.

SUMMARY OF THE INVENTION

A molded case circuit breaker thermal-magnetic trip unit is adapted to respond to a mechanical rating plug that sets the travel distance between the operating mechanism trip initiating bar and the bimetal associated with the thermal-magnetic trip unit. The travel distance is calibrated to correspond to a specific circuit breaker ampere rating.

DESCRIPTION OF THE PREFERRED EMBODIMENT

Figure 1:
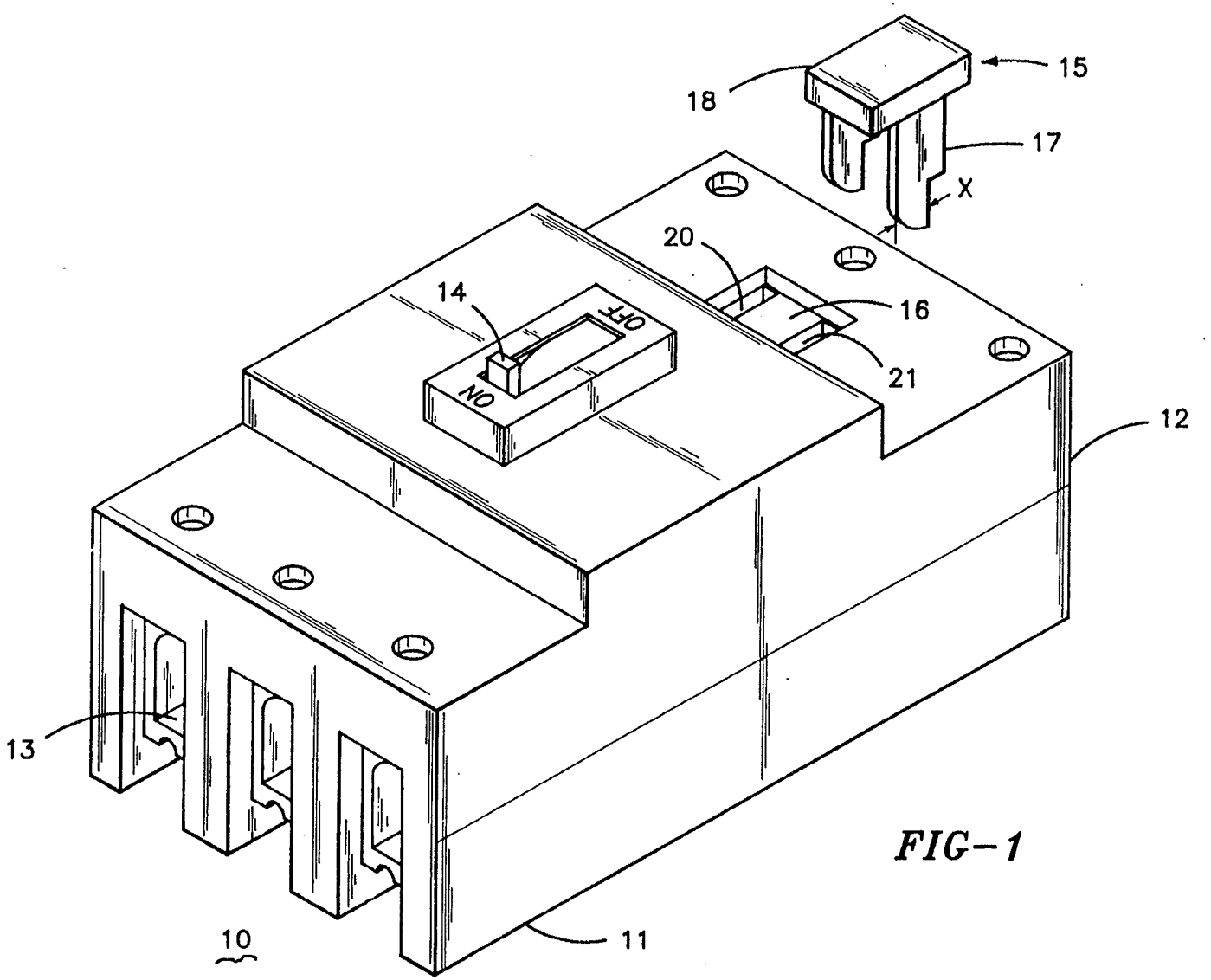
FIG. 1 is a top perspective view of a molded case circuit breaker utilizing a thermal-magnetic trip unit with a mechanical rating plug shown in isometric projection.

An industrial-rated circuit breaker 10 utilizing a thermal-magnetic trip unit is depicted in FIG. 1 and consists of a case 11 to which a cover 12 is attached. A circuit breaker operating handle 14 extends through a slot formed within the circuit breaker cover for manual intervention to turn the circuit breaker to its ON and OFF conditions. The circuit breaker is electrically connected within a protected circuit by means of the line lugs 13 arranged at the line end of the circuit breaker. Although not shown, A similar arrangement of load lugs are arranged at the opposite load end of the circuit breaker. The mechanical rating plug 15 allows a single circuit breaker design to be used over a wide range of ampere ratings. The rating plug includes a top insulative rectangular block 18 with a pair of spaced extensions or legs 17 extending from a bottom. As will be described below, the width x defining the legs 17 are predetermined to set the ampere rating of the thermal-magnetic trip unit contained within the circuit breaker case. The rating plug is inserted within the recess 16 formed in the cover whereby the legs extend downwards within the corresponding slots 20, 21.

Figure 2:
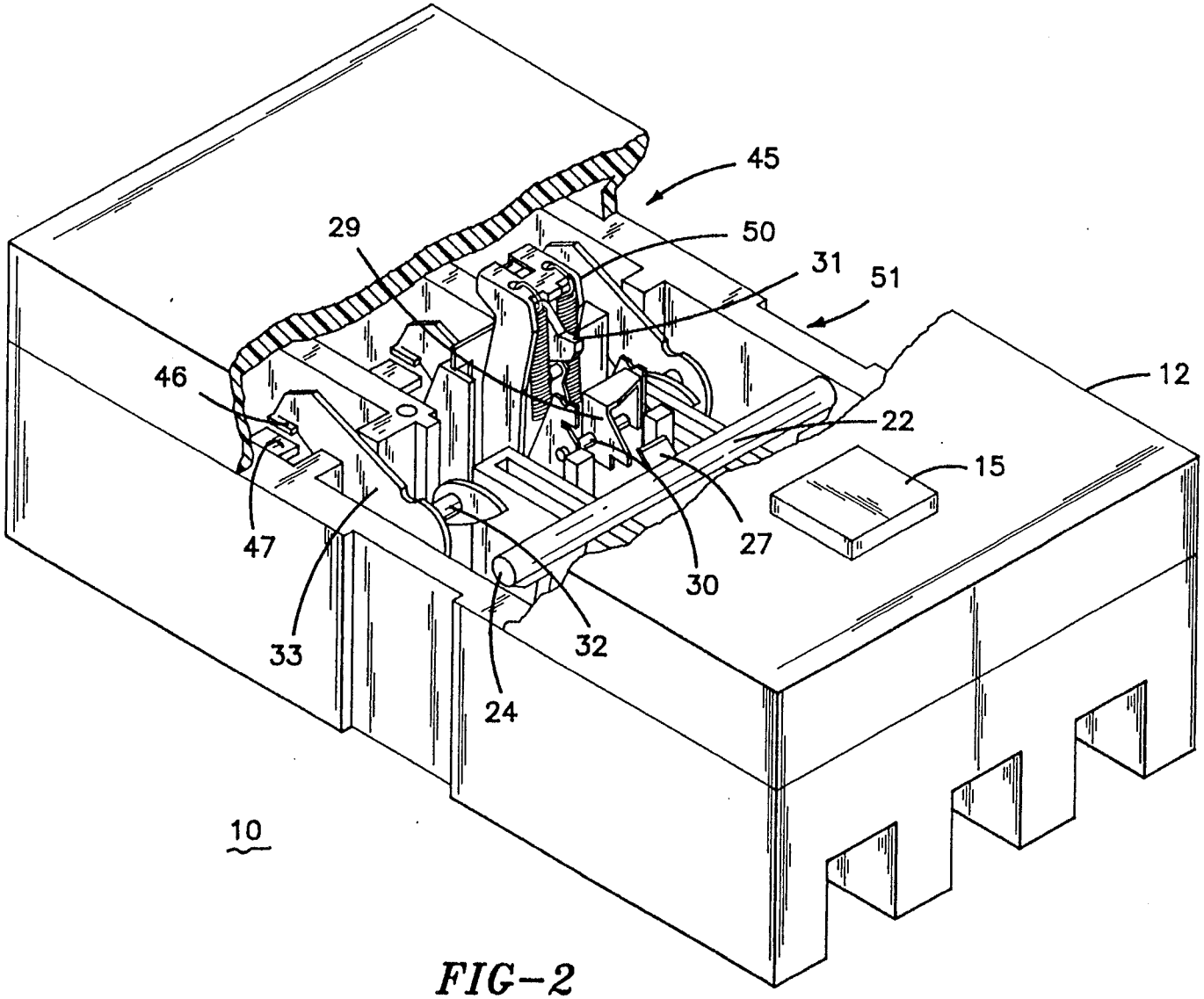
FIG. 2 is a top perspective view of the molded case circuit breaker of FIG. 1 with the cover partially removed to depict the circuit breaker operating mechanism, trip bar assembly and associated contact arms.
Figure 3:
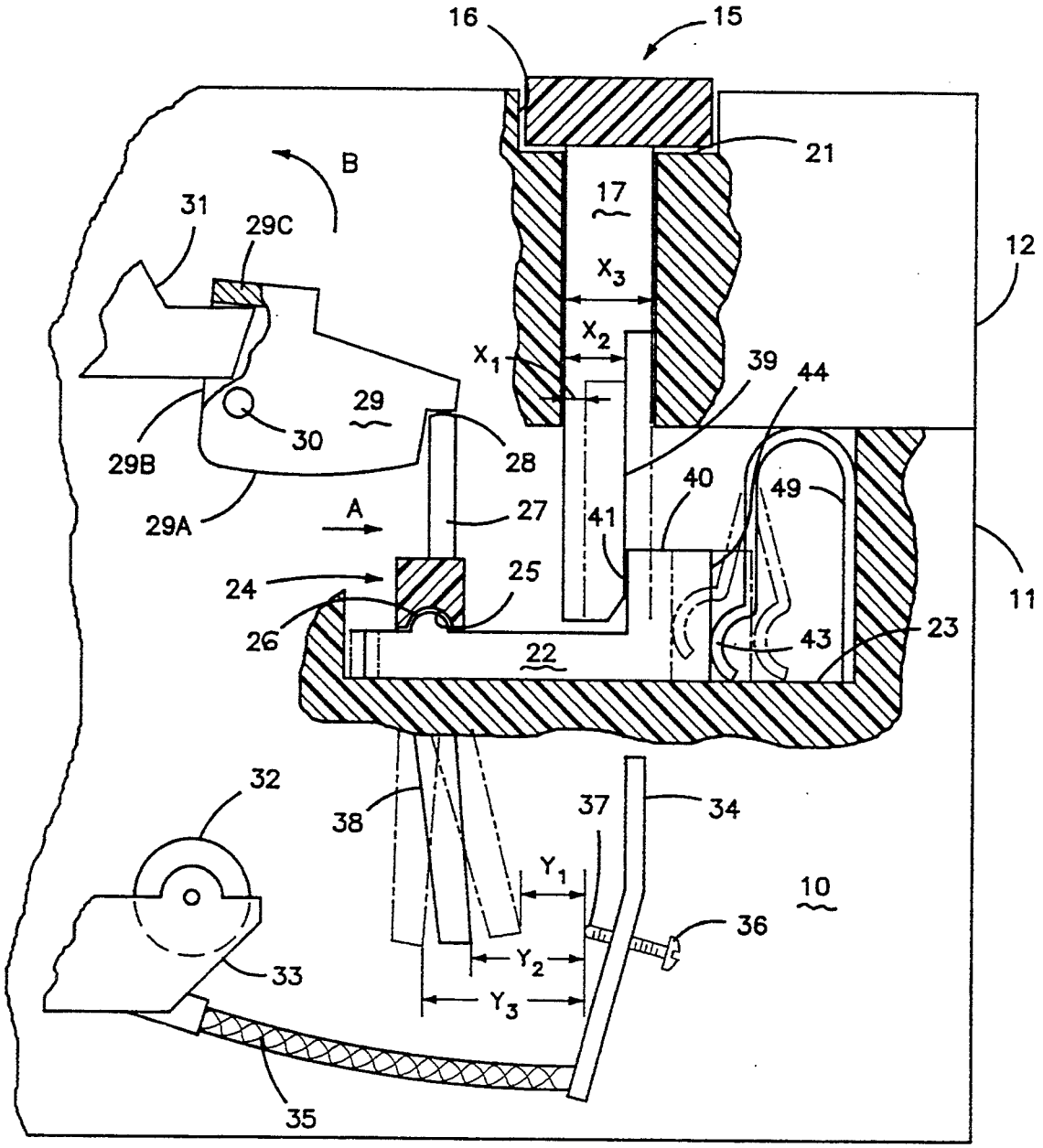
FIG. 3 is an enlarged side view in partial section of the mechanical rating plug assembly within the circuit breaker of FIGS. 1 and 2.

Before describing the operation of the rating plug to set the circuit breaker ampere rating, it is helpful to review the operation of the circuit breaker operating mechanism 45 to separate the circuit breaker movable and fixed contacts 46, 47 depicted in FIG. 2. The operating mechanism is similar to that described within U.S. Pat. No. 4,736,174 entitled "Molded Case Circuit Breaker Operating Mechanism". The movable contacts 46 are arranged at the ends of corresponding movable contact arms 33 which operate off the insulative crossbar assembly 32. The latching arrangement indicated at 51 includes a latch 29 which is rotatable about a pivot 30 and which restrains the cradle 31 from rotation under the urgance of the powerful operating springs 50 to drive the movable contact arms 33 and the movable contacts 46 out of circuit with the fixed contacts 47. The trip bar 24 is shown in the "tripped" position with the latch plate 27, extending from the top of the trip bar, out from under the latch 29 and the movable contact arms 33 rotated to their open positions. The rating plug 15 inserted within the cover 12 interacts with the trip bar 24 by means of a slide plate 22 in the manner best seen by referring now to the partial section of the circuit breaker 10 shown in FIG. 3.

The cradle 31 is depicted trapped under the U-shaped latch 29 which latch is restrained from rotation about the pivot 30 by the positioning of the latch plate 27 under the latch slot 28. The U-shaped latch includes a pair of opposing legs 29A, 29B joined by a top bight as indicated at 29C. When the latch plate is translated in the direction indicated by arrow A, the cradle 31 rotates in the direction indicated by arrow B to allow the rotation of the movable contact arm 33 and the associated crossbar 32 as described earlier. Electric circuit between the bimetal 34 and the movable contact arm 33 is provided by the braid conductor 35, as indicated. The movement of the trip bar 24 to which the latch plate 27 is fixedly secured, is governed by the leg 38 extending from the bottom of the trip bar and arranged for impact by the end 37 of the calibration screw 36 that is inserted through the bimetal 34. When the current through the bimetal is sufficient to displace the bimetal against the leg 38 of the trip bar 24, the trip bar translates in the direction of the arrow A described earlier, and displaces the latch plate 27 out from under the latch slot 28 to articulate the operating mechanism in the manner described earlier. The trip bar 24 is connected to the slide plate 22 by trapping the protrusion 26 on the slide plate under the groove 25 formed within the trip bar. To set the ampere rating of the circuit breaker 10, the width x of the leg 17 is adjusted on the rating plug 15 that extends within the recess 16. The bottom part 39 of the leg 17 further extends within the slot 21 down to within the slide plate 22 and abuts the front side 41 of the slide plate post 40. The slide plate is positioned against the end 39 of the spacer extension 17 by means of the transverse force exerted against the rear surface 44 of the slide plate post 40 by the radial end 43 of the powerful bias spring 49 and translates along the surface of the shelf 23 integrally-formed within the circuit breaker case 11. As depicted in phantom the thickness X1, X2, X3 is calibrated to accurately set the distances of travel Y1, Y2, Y3 as between the end 37 of the bimetal calibration screw 36 and leg of the trip bar as also indicated in phantom. The positional relationship between the radial end 43 of the bias spring 49 and the slide plate 22 automatically adjusts the location of the slide plate and the latch plate 27 under the latching slot 28 to insure a constant tripping force between the cradle 31 and the latch 29 and a constant displacement force between the leg 38 of the trip bar 24 and the end 37 of the calibration screw 36. This constant tripping force provision is an important feature of the invention since it allows common operating mechanism components to be used with the different ampere ratings and lets the separation distances Y1, Y2, Y3 accurately determine the ratings. The higher ratings correspond to the larger separation distances which are predetermined by the manufacturer and are calibrated to the user's specification by means of the adjustment screw 36.

An industrial-rated circuit breaker has herein been described allowing a large variation in circuit breaker ampere ratings to be provided within a common circuit breaker enclosure having common operating components by means of a mechanical rating plug assembly. Large numbers of the common enclosures are stocked at the point of distribution along with corresponding rating plugs in lieu of different-sized circuit breaker enclosures for each of the various ampere ratings.

We claim:

1. A rating plug assembly for thermal-magnetic circuit breakers comprising:
   - a slide plate arranged for translation within a first recess formed within a circuit breaker case;
   - a post upstanding from one end of said slide plate and arranged for contacting a rating plug spacer-extension on a forward side and for contacting a bias spring on a rear side thereof;
   - a trip bar within said first recess interacting with a spacer-extension having a predetermined width and length, said trip bar interacting with said slide plate and a circuit breaker latch for articulating the circuit breaker latch when displaced by a circuit breaker bimetal unit under overcurrent circuit conditions.

2. The rating plug assembly of claim 1 wherein said trip bar includes a central part, a latch plate extending from a top of said central part and a leg extending from a bottom of said central part, said latch plate being trapped under a latching slot on said latch to restrain said latch under quiescent circuit conditions.

3. The rating plug assembly of claim 1 wherein said latch plate is displaced by contact with a circuit breaker bimetal unit under overcurrent circuit conditions.

4. The rating plug assembly of claim 1 wherein said slide plate includes a protrusion upstanding from an opposite end of said slide plate, said protrusion being received within a groove within said central part.

5. The rating plug assembly of claim 1 wherein said spacer-extension is arranged within a second recess within a circuit breaker case.

6. The rating plug assembly of claim 4 wherein said predetermined width of said spacer-extension defines a predetermined separation distance between a circuit breaker bimetal and said leg of said trip bar.

7. A thermal-magnetic circuit breaker having a field-installable rating plug for setting the circuit breaker ampere ratings comprising:
   - a circuit breaker cover attached to a circuit breaker case;
   - an operating mechanism arranged within said case for interrupting circuit current upon the occurrence of an overcurrent condition;
   - a latch restraining said operating mechanism from interrupting circuit current under quiescent circuit conditions;
   - a rating plug support member adapted to be received partially within said cover; and
   - a spacer-extension depending from a bottom surface of said support and adapted to be received within said case, said spacer-extension having a predetermined width and length, 8. The thermal-magnetic circuit breaker of claim 7 including:
   - a slide plate arranged for translation within a first recess formed within said circuit breaker case; and
   - a post upstanding from one end of said slide plate and arranged for contacting said spacer-extension on a forward side and for contacting a bias spring on a rear side thereof.

9. The thermal-magnetic circuit breaker of claim 7 including a trip bar within said first recess interacting with a spacer-extension having a predetermined width and length, 10. The thermal-magnetic circuit breaker of claim 9 wherein said trip bar includes a central part, a latch plate extending from a top of said central part and a leg extending from a bottom of said central part, said latch plate being trapped under a latching slot on said latch to restrain said latch under quiescent circuit conditions.

11. The thermal-magnetic circuit breaker of claim 7 wherein said latch plate is displaced by contact with a circuit breaker bimetal unit under overcurrent circuit conditions.

12. The thermal-magnetic circuit breaker of claim 8 wherein said spacer-extension is arranged within a second recess within a circuit breaker case.

13. The thermal-magnetic circuit breaker of claim 7 wherein said spacer-extension defines a predetermined width and length, 14. The thermal-magnetic circuit breaker of claim 7 wherein said predetermined width of said spacer-extension defines a predetermined separation distance between a circuit breaker bimetal and said leg of said trip bar.

* * * * *